US005273570A

United States Patent [19]

Sato et al.

[11] Patent Number: 5,273,570

[45] Date of Patent: Dec. 28, 1993

[54] SECONDARY HARDENING TYPE HIGH TEMPERATURE WEAR-RESISTANT SINTERED ALLOY

[75] Inventors: Katsuaki Sato; Katsuhiko Tominaga, both of Wako; Tsutomu Saka, Wako; Osamu Kawamura; Teruo Takahashi, both of Shimotsuga; Arata Kakiuchi, Shimotsuga, all of Japan

[73] Assignees: Honda Giken Kogyo Kabushiki Kaisha, Japan; Nippon Piston Ring Co., Ltd., Japan

[21] Appl. No.: 840,828

[22] Filed: Feb. 25, 1992

[30] Foreign Application Priority Data

Feb. 27, 1991 [JP] Japan ..... 3-055806
Jan. 21, 1992 [JP] Japan ..... 4-030162

[51] Int. Cl.[5] ..... C22C 29/00

[52] U.S. Cl. ..... 75/231; 75/239; 75/240; 75/243; 75/246

[58] Field of Search ..... 75/231, 239, 240, 241, 75/242, 243, 246

[56] References Cited

U.S. PATENT DOCUMENTS

| | | | |
|---|---|---|---|
| 3,863,318 | 2/1975 | Niimi et al. | 75/241 |
| 3,982,905 | 9/1976 | Osawa et al. | 428/566 |
| 3,999,952 | 12/1976 | Kondo et al. | 428/566 |
| 4,035,159 | 7/1977 | Hashimoto et al. | 75/246 |
| 4,080,205 | 3/1978 | Niimi et al. | 75/241 |
| 4,491,477 | 1/1985 | Suganuma et al. | 75/230 |
| 4,678,523 | 7/1987 | Sridhar et al. | 148/325 |
| 4,778,522 | 10/1988 | Maki et al. | 75/238 |
| 4,808,226 | 2/1989 | Adam | 75/246 |
| 4,836,848 | 6/1989 | Mayama et al. | 75/231 |
| 4,859,164 | 8/1989 | Shimomura | 418/179 |
| 4,861,372 | 8/1989 | Shimomura | 75/232 |
| 4,904,302 | 2/1990 | Shimomura | 75/232 |
| 4,915,735 | 4/1990 | Motooka | 75/231 |
| 4,933,008 | 6/1990 | Tujiki et al. | 75/244 |
| 4,964,908 | 10/1990 | Greetham | 75/241 |
| 4,970,049 | 11/1990 | Baker et al. | 419/11 |
| 4,976,916 | 12/1990 | Shimomura | 419/25 |
| 5,080,713 | 1/1992 | Ishibashi et al. | 75/246 |
| 5,082,433 | 1/1992 | Leithner | 419/11 |

*Primary Examiner*—Donald P. Walsh
*Assistant Examiner*—Ngoclan T. Mai
*Attorney, Agent, or Firm*—Parkhurst, Wendel & Rossi

[57] ABSTRACT

A secondary hardening type high temperature wear-resistant sintered alloy body comprising 0.4 to 15 wt. % of at least one species of metal carbide forming element which is selected from the group consisting of W, Mo, V, Ti, Nb, Ta and B; 5 to 35 wt. % of at least one species of austenite forming element which is selected from the group consisting of Ni, Co, Cu, and Cr; 0.2 to 1.2 wt. % of C; and 0.04 to 0.2 wt % of the remainder consisting essentially of Fe wherein the alloy body contains an austenite phase which is capable of martensitic transformation.

7 Claims, 8 Drawing Sheets

SECONDARY HARDENING TYPE HIGH TEMPERATURE WEAR-RESISTANT SINTERED ALLOY

BACKGROUND OF THE INVENTION

The present invention relates to a secondary hardening type high temperature wear-resistant sintered alloy, and more specifically to a secondary hardening type high temperature wear-resistant sintered alloy which has no only excellent wear resistance, heat resistance, strength and corrosion resistance, but also has a good workability (or working characteristic) and may suitably be used for a material for forming a valve seat to be used for an internal combustion engine, for example.

In general, a secondary hardening type sintered alloy which is capable of having increased the hardness or strength on the basis of a pressure or a thermal load which is to be applied thereto after the working thereof, has been used for tool steel. In addition, the secondary hardening type sintered alloy may suitably be used as a material constituting a valve seat to be used for an internal combustion engine. Particularly, various investigations have been made as to the possibility thereof of such material for the valve seat to be used for an internal combustion engine.

On the other hand, the environment in which the valve seat for the internal combustion engine is to be used has steadily become severe along with an improvement in the performance of the engine. In Order to attain an engine which has plural valves (i.e., multi valve engine), which is capable of effecting combustion in a dilute phase at a high temperature, and which is capable of rotating at a high speed, it is necessary to improve the characteristics of the valve seat such as the wear resistance, heat resistance and strength.

Hitherto, there has generally been used an iron type sintered alloy as the material for forming the valve seat for the internal combustion engine. In order to improve the characteristics of the valve seat for the internal combustion engine which is formed of such a conventional iron type sintered alloy, various investigations have been made.

For example, in an attempt to increase wear resistance of known iron type sintered alloys, hard particles comprising a Stellite type alloy, Eatnite type alloy, and various ceramics (e.g., carbides, oxides, nitrides, etc.) have been added thereto, a solid lubricating agent such as Pb, Pb alloy, graphite, fluoride, and sulfide have been added or infiltrated thereto, an oxide layer (or film) has been formed, on a surface thereof, and such iron type alloys which have been treated with steam, etc. Particularly, there has widely been used the iron type to which the hard particles as described above have been added.

In addition, in an attempt to improve heat resistance of known iron type alloys wherein the pores thereof have been sealed by use of Cu or a Cu alloy, and such iron type alloys have been subjected to forging, repressing, etc., so that the true density thereof is increased or it is densified. Also an alloy element such as Co, Ni and P have been added to such iron type alloys.

In addition, in an attempt to improve strength of such iron type, such alloys have been subjected to the same treatment as that for the above improvement in the heat resistance, and have been heat treated after the attempted improvement in wear resistance and heat resistance as described above.

In the iron type alloy as described above, however, by attempting to improve wear resistance (e.g., by increasing the amount of the above hard particles to be added thereto), the workability (or cuttability) thereof is decreased, and further, the compression molding property and the sintering property are deteriorated, whereby the strength of the sintered product is decreased. In such a case, when the resultant iron type alloy is used as a valve seat for an internal combustion engine, the valve to be used in combination therewith is liable to be worn. In addition, by attempting to improve wear resistance by adding or infiltrating a solid lubricating agent to the alloy, there is posed a problem such that the strength of the alloy is decreased. Further, by attempting to improve resistance by the formation of the oxide layer or by steam treatment, there is posed a problem such that the strength and tenacity thereof are decreased. Furthermore, in the conventional iron type alloy, the wear resistance, heat resistance and strength are intended to be improved simultaneously, the number of the steps constituting such a production process is increased and the amount or number of the materials to be used for such a production process is increased. As a result, there is posed a problem such that the production cost of such an alloy is raised.

On the other hand, there have been developed various engines which are capable of using a gasoline alternate fuel (i.e., a fuel which is usable for an engine in place of gasoline) on the basis of the demands such as the protection of the earth environment and the reduction in the amount of crude oil to be consumed. Among such engines, in the case of an engine using an alcohol as a fuel, since corrosion based on formic acid produced in the cylinder thereof accelerates or promotes the wear of the valve seat, the material for constituting the valve seat is required to have a sufficient corrosion resistance. However, the valve seat for an internal combustion engine which has been formed of a conventional material, does not have a sufficient corrosion resistance required for the alcohol engine in addition to the performances required for the conventional engine.

Accordingly, a material having improved characteristics such as wear resistance, heat resistance strength, and corrosion resistance while maintaining good workability, has been desired.

SUMMARY OF THE INVENTION

Accordingly, an object of the present invention is, in view of the circumstances as described above, to provide a secondary hardening type high temperature wear-resistant sintered alloy which has a good powder compression formability in the production process therefor, does not decrease the workability when it is formed into a sintered alloy having a low hardness, is capable of being subjected to a secondary hardening at the time of use thereof on the basis its intended of the environment so that it may exhibit an excellent wear resistance (or abrasion resistance), and has an excellent heat resistance and an excellent strength. Particularly, when the sintered alloy which is to be provided by the present invention is used for a valve seat for an internal combustion engine, it remarkably shows the effect thereof. In other words, a material having a high hardness is required for a valve seat on the exhaust side because of severe operating conditions, and such a material has a considerably poor workability. However, when the secondary hardening type high temperature wear-resistant sintered alloy according to the present invention is used, it is expected to obtain a valve seat which is excellent in the workability and exhibits high performance.

According to the present invention, there is provided a secondary hardening type high temperature wear-resistant sintered alloy, wherein an alloy constituting a matrix comprises 0.4 to 15 wt. % of at least one species of metal carbide forming element which is selected from the group consisting of W, Mo, V, Ti, Nb, Ta and B; 5 to 35 wt. % of at least one species of austenite forming element which is selected from the group consisting of Ni, Co, Cu, and Cr; and 0.2 to 1.2 wt. % of C: and the remainder substantially consists of Fe: and the matrix contains an austenite phase which is capable of martensitic transformation.

The matrix may include 30 wt. % or less of hard particles, 0.04 to 0.2 wt. % of Al; 0.04 to 0.2 wt. % of Al and 30 wt. % or less of hard particles; 0.1 to 0.6 wt. % of P.

Further, the matrix may include 0.1 to 0.6 wt. % of P and 30 wt. % or less of hard particles; 0.04 to 0.2 wt. % of Al and 0.1 to 0.6 wt. % of P; and 0.04 to 0.2 wt. % of Al, 0.1 to 0.6 wt. % of P and 30 wt. % or less of hard particles. The present invention further provides a secondary hardening type high temperature wear-resistant sintered alloy as described above, wherein a self-lubricating material has been deposited at grain boundaries or in the particles in an amount of 0.2 to 5 wt. %.

The present invention further provides a secondary hardening type high temperature wear-resistant sintered alloy as described above, wherein the self-lubricating material is selected from the group consisting of fluoride, sulfide and lead oxide.

The present invention further provides a secondary hardening type high temperature wear-resistant sintered alloy as described above, wherein pores have been sealed with a sealing agent comprising at least one species which is selected from the group consisting of Cu, Pb, a Cu alloy, and a Pb alloy.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1A:
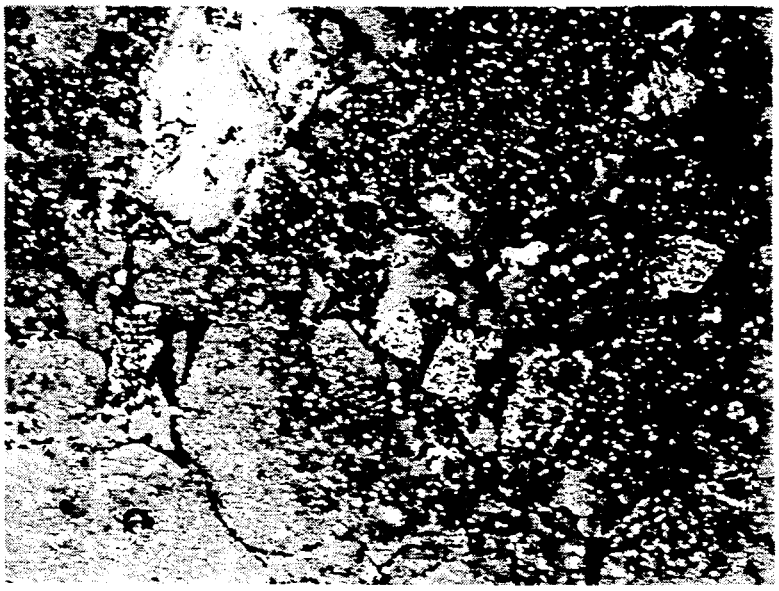
FIG. 1A is a metallographic photograph showing the Sample according to Example 1 before the wear test therefor.

Hereinbelow, the respective components etc., of the secondary hardening type high temperature wear-resistant sintered alloy according to the present invention will be described.

Elemental Components For Forming Metal Carbide

The secondary hardening type high temperature wear-resistant sintered alloy according to the present invention contains at least one species of metal carbide forming element which is selected from the group consisting of W, Mo, V, Ti, Nb, Ta and B.

The metal carbide forming element used herein refers to an element which is capable of forming a metal carbide separated by MC or $M_6C$ wherein M denotes a metal element. More specifically, such an element comprises at least one species of element which is selected from the group consisting of tungsten (W), molybdenum (Mo), vanadium (V), titanium (Ti), niobium (Nb), tantalum (Ta), and boron (B).

In the secondary hardening type high temperature wear-resistant sintered alloy according to the present invention, the above metal carbide forming element may generally be contained in an amount of 0.4 to 15 wt. %, more preferably 6 to 12 wt. %. If the above amount of the metal carbide forming element is smaller than 0.4 wt. %, the hardness is not sufficiently increased due to the secondary hardening in some cases so that the effect of improving the wear resistance (or abrasion resistance) is not sufficiently shown. On the other hand, if the amount of the metal carbide forming element is larger than 15 wt. %, the amount of the carbide deposited in the sintered product becomes too large and the resultant hardness is excessively improved in some cases so that the cuttability (cutting property) can be lowered. However, with respect to the vanadium (y), titanium (Ti) and niobium (Nb), the carbide thereof is deposited in a state having an edge. As a result, when a valve seat for an internal combustion engine is formed by use of a secondary hardening type high temperature wear-resistant sintered alloy comprising such a metal, the resultant valve seat has too large of an attacking property with respect to the valve to be used in combination therewith. Accordingly, in a case where the secondary hardening type high temperature wear-resistant sintered alloy is used as a material for forming the valve seat for an internal combustion engine, when the metal carbide forming element comprises at least one species selected from the group consisting of vanadium (V), titanium (Ti) and niobium (Nb), the content thereof may preferably be 0.4 to 2 wt. %. However, when tungsten (W) or molybdenum (Mo) is mixed therein, the above content may be increased to 15 wt. %.

In the secondary hardening type high temperature wear-resistant sintered alloy according to the present invention, the wear resistance thereof is intended to be improved by incorporating therein the metal carbide forming element in the amount as described above. More specifically, when the secondary hardening type high temperature wear-resistant sintered alloy is produced by sintering, the metal carbide forming element is deposited in the form of a minute MC type or $M_6C$ type carbide (generally having a particle size of 2 μm or below) in the austenite particles, and when the carbide is subjected to an aging treatment, it is formed into nuclei which further grow and simultaneously the amount of the deposited carbide is increased. On the other hand, the amount of carbon contained in the base is decreased in an inverse proportion to the increase in the amount of the above metal carbide. As a result, the martensite transformation temperature (hereinafter, referred to as "Ms point") is elevated and the martensitic transformation ordinarily occurs at a temperature of 200° to 400° C. In addition, in combination with the increase in the hardness due to the carbide newly deposited, the secondary hardening occurs so that the wear resistance is improved. At this time, since the above temperature range corresponds to the ambient temperature for an engine, the secondary hardening type high temperature wear-resistant sintered alloy may suitably be used as a material for forming a valve seat for an internal combustion engine.

Austenite Forming Element Component

The secondary hardening type high temperature wear-resistant sintered alloy according to the present invention contains at least one species of austenite forming element which is selected from the group consisting of Ni, Co, Cu and Cr. When the austenite forming element is contained in the base, it has a function of improving the heat resistance, corrosion resistance and strength, and suppresses the martensitic transformation or the pearlite transformation so that it forms an austenite base which is capable of being subjected to the secondary hardening on the basis of the aging, processing or machining. The processing used herein includes the striking due to a valve, when a valve seat for an internal combustion engine is formed. In addition, depending on a condition (high temperature, or long period of time), the Ni contained in the martensite base is deposited as an intermetallic compound such as $Ni_3Ti$, $Ni_3Mo$, $Ni_3Nb$, and NiAl so as to further improve the hardness.

In general, the austenite forming element may be contained in an amount of 5 to 35 wt. %, more preferably 10 to 30 wt. %. If the above amount of the austenite forming element to be contained is smaller than 5 wt. %, the heat resistance, corrosion resistance or strength may insufficiently be improved and the austenite may insufficiently be formed in some cases. On the other hand, the above amount is larger than 35 wt. %, the resultant austenite becomes too stable so that the secondary hardening is less liable to occur.

Carbon (C) Component

The C Component contained in the secondary hardening type high temperature wear-resistant sintered alloy according to the present invention has a function of lowering the Ms point. In general, the amount of the C component to be contained may be 0.2 to 1.2 wt. %, more preferably 0.4 to 0.8 wt. %. If the amount of the C component to be contained is smaller than 0.2 wt. %, free ferrite component may be deposited so that the improvement in the wear resistance can be obstructed. On the other hand, if the amount of the C component to be contained is larger than 1.2 wt. %, free cementite may be deposited at the time of the sintering so as to impair the cuttability (or cutting property). In addition, the Ms point becomes too low (not higher than 100° C.) and the martensitic transformation does not occur in some cases due to the aging treatment after the cutting or processing thereof. As a result, the secondary hardening does not occur and the hardness and the wear resistance are not improved in some cases. The C component used herein refers to one to be contained in the base (or matrix) on the basis of the diffusion from a powder material such as carbon powder. Accordingly, for example the above "C component" does not include the carbon contained in a carbide which can be added as a hard phase, or combined carbon and free carbon to be contained in other hard powder.

Hard Particle (Powder) Component

The hard particle (or powder) component to be contained in the secondary hardening type high temperature wear-resistant sintened alloy according to the present invention has a function of improving the wear resistance when it is dispersed in the matrix. When the amount of the hard powder to be dispersed is considerably increased, a decrease in the workability and strength is invited and further the cost of the production of the secondary hardening type high temperature wear-resistant sintered alloy is raised. Accordingly, in the secondary hardening type high temperature wear-resistant sintered alloy according to the present invention the amount of the hard powder contained therein has an upper limit of 30 wt. %. More specifically, it is possible to add a desired amount of the hard powder within the range of not higher than 30 wt. % depending on the condition under which it is to be used. If the amount of the hard powder to be contained is larger than 30 wt. %, a decrease in the workability and the strength is invited and further the cost of the production of the secondary hardening type high temperature wear resistant sintered alloy is raised as described above.

Specific examples of the hard powder to be contained in the amount as described above may include, e.g., powder or particles comprising a compound such as a stellite alloy (W-Cr-Co-C, W-Cr-Co-C-Fe), an eatonite type alloy, Mo Fe, and various ceramics (carbide, oxide, nitride, etc.).

In general, the hardness Hv of the hard powder may be 900 or higher.

Aluminum (Al) Component

The Al component to be contained in the secondary hardening type high temperature wear resistant sintered alloy according to the present invention may be deposited from the martensite matrix (e.g., as an intermetallic compound such as Ni-Al), and has a function of improving the wear resistance.

In general, the amount of the Al component to be contained may be 0.04 to 0.2 wt. %, more preferably 0.08 to 0.12 wt. %. If the amount of the Al component to be contained is smaller than 0.04 wt. %, the amount thereof to be deposited which is sufficient to improve the wear resistance is not reached in some cases. On the other hand, the above amount is larger than 0.2 wt. %, a firm or strong oxide layer or film formed in an alloy powder containing Al or the powder is weakened. As a result, the resultant compression property may be impaired and a sufficient strength of the sintered product cannot be obtained in some cases.

Phosphorus (P) Component

The P component to be contained in the secondary hardening type high temperature wear-resistant sintered alloy according to the present invention has a function of improving the sintering property between particles constituting hard alloy powder having a poor powder compression property at the time of the sintering so as to form a sintered product having a high density and a high strength. The amount of the P component to be contained having such a function may generally be 0.1 to 0.6 wt. %, more preferably 0.2 to 0.4 wt. %. If the amount of the P component to be contained is smaller than 0.1 wt. %, the above function of improving the sintering property between the particles is not sufficient in some cases. On the other hand, if the amount thereof to be contained is larger than 0.6 wt. %, the steadite is deposited at the grain boundaries, and a decrease in the cutting property and tenacity may be invited in some cases. Incidentally, the above range is one with respect to a case wherein the P component is positively added, and the range does not include a trace P component which can inevitably be contained in the material powder.

Self-Lubricating Material

The self-lubricating material to be contained in the secondary hardening type high temperature wear-resistant sintered alloy according to the present invention may be deposited at the grain boundaries or within the particles. More specifically, the self-lubricating material may be deposited at the grain boundary or in the inside of the particles by using iron powder which preliminarily contains a self-lubricating material such as MnS, or by incorporating MnS powder, etc..

Specific examples of such a self-lubricating material may include fluorides, sulfides and lead oxides, etc.. The amount of the self-lubricating material to be contained may generally be 0.2 to 5 wt. %, more preferably 0.5 to 3 wt. %. If the amount of the above material to be contained is smaller than 0.2 wt. %, the effect of the addition of the self-lubricating material. (i.e., the effect of improving the self-lubricating property so as to improve the wear resistance), is not sufficient in some cases. On the other hand, if the above amount is larger than 5 wt. %, a decrease in the strength or corrosion resistance is invited in some cases.

Pore Sealing Material

The secondary hardening type high temperature wear-resistant sintered alloy according to the present invention may be subjected to a pore sealing treatment by use of at least one species of pore sealing material which is selected from the group consisting of Cu, Pb, a Cu alloy, and a Pb alloy.

More specifically, such a pore sealing treatment may be effected, for example, by superposing a compression molded product of a pore sealing material on a compression molded product of a valve seat base material (or skeleton) and passing the resultant superposition through a sintering furnace. Alternatively, such a treatment may also be effected, for example, by dipping a valve seat base material in a molten bath of a pore sealing material On the basis of the pore sealing treatment, the resultant product is has a higher density and a higher denseness and the heat resistance and the strength thereof may also be improved.

Others

The secondary hardening type high temperature wear-resistant sintered alloy according to the present invention is an iron type sintered alloy which contains the respective components as described above and the remainder thereof substantially comprises iron (Fe). Upon sintering, it comprises a matrix texture which mainly comprises an austenite phase comprising a minute MC type or $M_6C$ type carbide on at least the sliding surface thereof and is capable of being cut or ground. The matrix texture has a property such that it deposits a hard phase (carbide, martensite, intermetallic compound) so as to increase the hardness and strength thereof on the basis of heat or pressure which is to be applied thereto after predetermined processing. The austenite phase as described above may include some embodiments such as (1) 100 % of austenite ($\gamma$), (2) $\gamma$+martensite (M), (3) $\gamma$+M+pearlite (P), $\gamma$+M+P, etc. A secondary hardening type high temperature wear-resistant sintered alloy having such a property may be produced, for example, in the following manner.

First, the respective components as described above are sufficiently mixed according to the respective amounts as described above. In such a mixing treatment, for example, a V-shaped mixer may suitably be used.

Then, the resultant mixed powder produced by the above mixing treatment is subjected to compression molding so as to provide a desired shape or configuration. In general, such compression molding may preferably be effected so as to provide a density of not lower than 6.8 g/cm$^3$.

Then, the resultant compression molded product produced by the above compression molding is subjected to a sintering treatment so as to sinter the compression molded product. The above sintering treatment may be effected in a non-oxidative (or non-oxidating) atmosphere so as to prevent oxidation of the respective components constituting the sintered alloy. It is somewhat difficult to definitely determine the sintering temperature and the sintering time since they can vary depending on the amount of the respective components, the shape or configuration, or the dimension of the compression molded product. However, in general, the sintering temperature may be about 1100° to 1200° C., and the sintering time may be about 20 to 60 min. It is further preferred to regulate the cooling rate in the sintering process or to subject the sintered product to a solution treatment so as to form in the matrix an austenite phase which is capable of being formed into a martensite in an environment wherein it is to be used.

The secondary hardening type high temperature wear-resistant sintered alloy according to the present invention to be produced in the above manner may preferably have a hardness ($H_{RB}$) of about 100 or below, and may have a good workability.

In addition, the secondary hardening type high temperature wear-resistant sintered alloy has improved wear resistance (or abrasion resistance), heat resistance, and strength, and also has a good corrosion resistance. Accordingly, such an alloy may suitably be used as a material for forming a valve seat for an internal combustion engine, for example. Particularly, when a valve seat for an internal combustion engine is formed by use of such an alloy, the resultant valve seat is assembled or mounted to a cylinder head and is subjected to predetermined processing or machining, and thereafter a predetermined hard phase is deposited therein on the basis of the combustion heat or striking due to the valve so as to increase the hardness and to provide a sufficient wear resistance under a condition under which the valve seat is to be used (i.e., in the initial stage of the starting of the engine). In addition, since the alloy according to the present invention also has excellent corrosion resistance, it is little affected by formic acid produced by the combustion of an alcohol when it is used for a valve seat for an engine which uses an alcohol as a fuel.

Hereinbelow, the present invention will be described in more detail with reference to Examples and Comparative Examples.

EXAMPLE 1

Powder material comprising base powder (150 mesh atomized iron powder comprising 18 wt. % of Ni, 6 wt. % of Mo, 4 wt. % of Co, 0.6 wt. % of Ti, 0.1 wt. % of Al and the remainder of Fe) to which 0.6 wt. % of graphite powder, 6 wt. % of Co powder as alloy element powder 11.5 wt. % of hard (powder) particles (comprising 19 wt. % of W, 10 wt. % of Co, 3 wt. % of C, 5 wt. % of Fe and the remainder of Cr, and 1.0 wt. % of zinc stearate as a lubricating agent for a mold (or molding tool) had been added was subjected to a mixing treatment by means of a V-shaped mixer for 10 min. to obtain mixed powder.

Then, the above mixed powder was subjected to compression molding so as to provide a shape corresponding to a valve seat or an internal combustion engine by use of an oil pressure press. Thereafter, the resultant compression molded product was subjected to a sintering treatment and then was cooled, whereby a valve seat for an internal combustion engine was prepared. In the above sintering treatment, an AX gas furnace was used and the compression molded product was subjected to the sintering treatment at a temperature of 1160° C. for 45 min. The cooling rate used herein was 16° C./min.

Then, the thus obtained valve seat for an internal combustion engine was subjected to an abrasion test (or wearing test). a secondary hardening test, a cutting property (cuttability) test, and a corrosion resistance test so that the wear resistance, secondary hardening property, cutting property and corrosion resistance thereof were evaluated. In addition, the density, radial crushing strength constant thereof and a change in the micro texture thereof before and after the abrasion test were investigated.

The composition and the results of the above tests are shown in Table 1 below. The remainder of the composition shown in Table 1 was Fe.

Figure 1B:
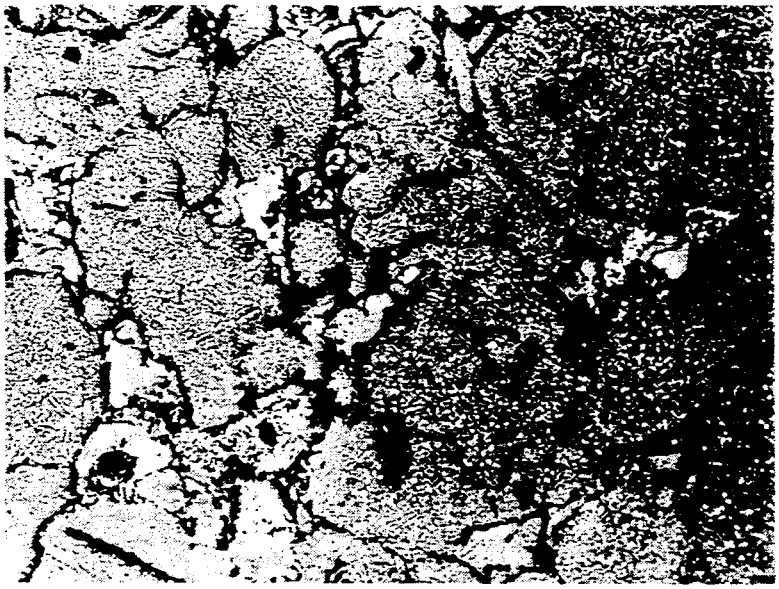
FIG. 1B is a metallographic photograph showing the same Sample after the wear test therefor.

The photographs showing the textures of the sample (valve seat) as described above before and after the abrasion test are shown in FIGS. 1A and 1B.

The abrasion test, the secondary hardening test, the cutting property (cuttability) test, and the corrosion resistance test were effected in the following manner. In addition, the density, radial crushing strength constant of the sample and a change in the micro texture of the sample before and after the abrasion test were investigated in the following manner.

Abrasion Test

Figure 8:
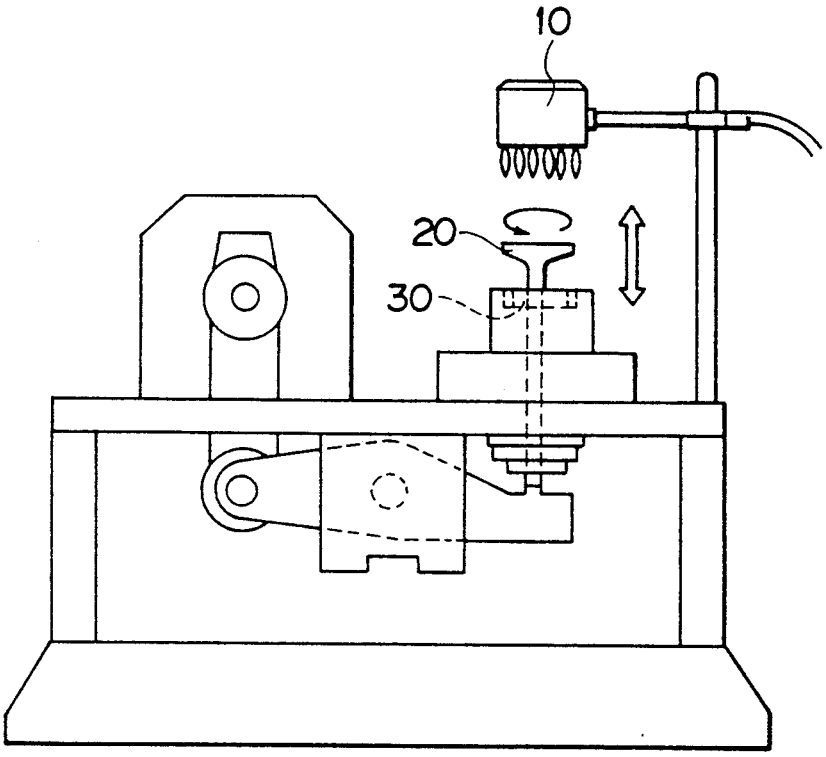
FIG. 8 is a view for schematically illustrating an abrasion tester to be used in Examples and Comparative Examples as described hereinafter.

The abrasion (or wearing) of the valve seat was evaluated under the following conditions by use of a valve seat abrasion tester as shown in FIG. 8. In the valve seat abrasion tester shown in FIG. 8, the reference numeral 10 denotes a heat source the reference numeral 20 denotes a valve, and the reference numeral 30 denotes the valve seat.

Testing temperature: 400° C. (seat surface temperature)
Repetition rate: 3,000 r.p.m.
Set load: 61.5 kgf (at the time of lifting) 25.2 kgf (at the time of seating)
Lifting amount: 9 mm
Valve rotation: 20 r.p.m.
Testing time: 9 hours
Valve used in combination therewith: SUH751

Secondary Hardening Test

The change in the hardness of the matrix before and after the abrasion test was measured by use of a micro Vickers hardness tester.

Cutting Property Test

The cutting property was evaluated under the following conditions.

Cutting rate V: 50 m/min.
Feed rate f: 0.15 mm/rev.
Cutting d: 0.5 mm
Tool bit used: JIS KO1, 31 3, RO. 8

Corrosion Resistance Test

The respective samples of the valve seat were dipped into a 2 wt. % aqueous formic acid solution under the following conditions, and the loss in the weight thereof due to the corrosion was calculated according to the following formula.

Dipping temp.: 70° C.
Dipping time: 48 hours
Loss in weight due to corrosion = {[weight before corrosion) (weight after corrosion)]/(weight before corrosion)} × 100

Density

The density was measured according to JIS Z 2505 (Testing method for sintering density of metal sintered material).

Radial Crushing Strength Constant

The radial crushing strength constant was measured according to JIS Z 2507 (Testing method for radial crushing strength constant of sintered oil containing bearing).

Micro Texture Change

The change in the micro texture was observed by use of an X ray microanalyser using an EMPA (electron probe microanalyser).

Example 2

Powder material comprising base powder (−150 mesh atomized iron powder comprising 8 wt. % of Ni, 4 wt. % of Mo, 4 wt. % of Co, 0.3 wt. % of Mb, and the remainder of Fe) to which 0.6 wt. % of graphite powder, 3 wt. % of Co powder and 4 wt. % of Ni powder as alloy element powder, 10 wt. % of powder A (comprising 19 wt. % of W, 10 wt. % of Co, 3 wt. % of C, 5 wt. % of Fe and the remainder of Cr, and 16.5 wt. % of powder B (comprising 60 wt. % of Mo and the remainder of Fe), as hard powders; and 1.0 wt. % of zinc stearate as a lubricating agent for a mold (or molding tool) had been added was subjected to a mixing treatment by means of a V-shaped mixer for 10 min. to obtain mixed powder.

Them, the above mixed powder was treated in the same manner as in Example 1.

The composition and the results of the respective tests are shown in Table 1 below.

Figure 2A:
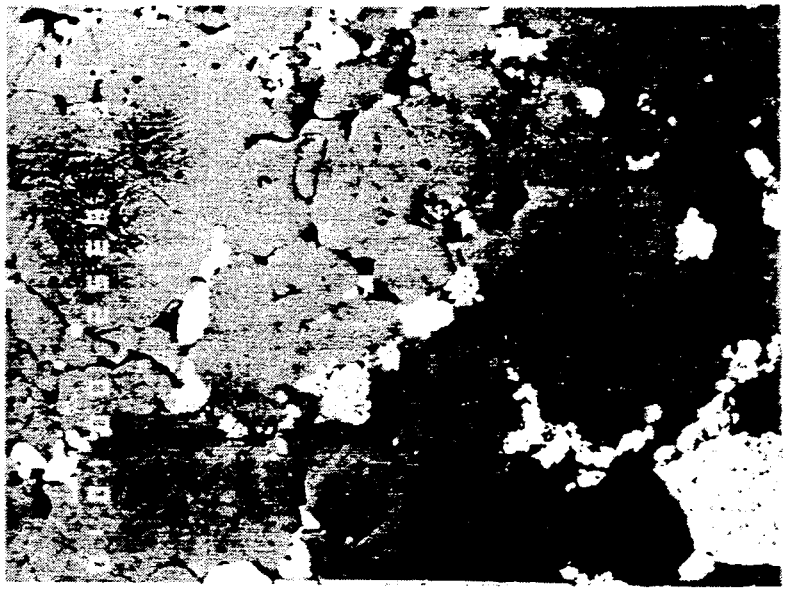
FIG. 2A is a metallographic photograph showing the Sample according to Example 2 before the wear test therefor.
Figure 2B:
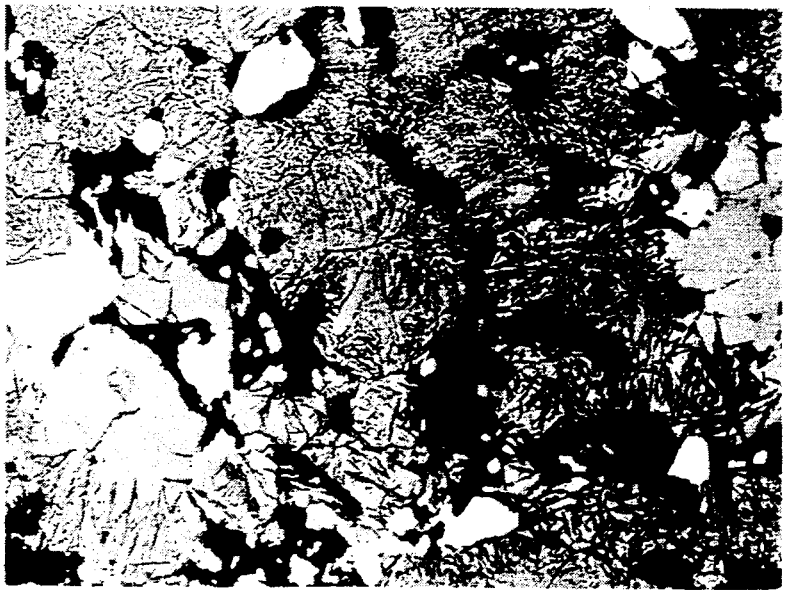
FIG. 2B is a metallographic photograph showing the same Sample after the wear test therefor.

The photographs showing the textures of the sample (valve seat) before and after the abrasion test are shown in FIGS. 2A and 2B.

EXAMPLE 3

The operations effected in Example 1 were repeated except that −150 mesh atomized iron powder (comprising 18 wt. % of Ni, 10 wt. % of Mo, 4 wt. % of Co, 0.6 wt. % of Nb, and the remainder of Fe) was used as base powder in place of the base powder used in Example 1.

The composition and the results of the respective tests are shown in Table 1 below.

Figure 3A:
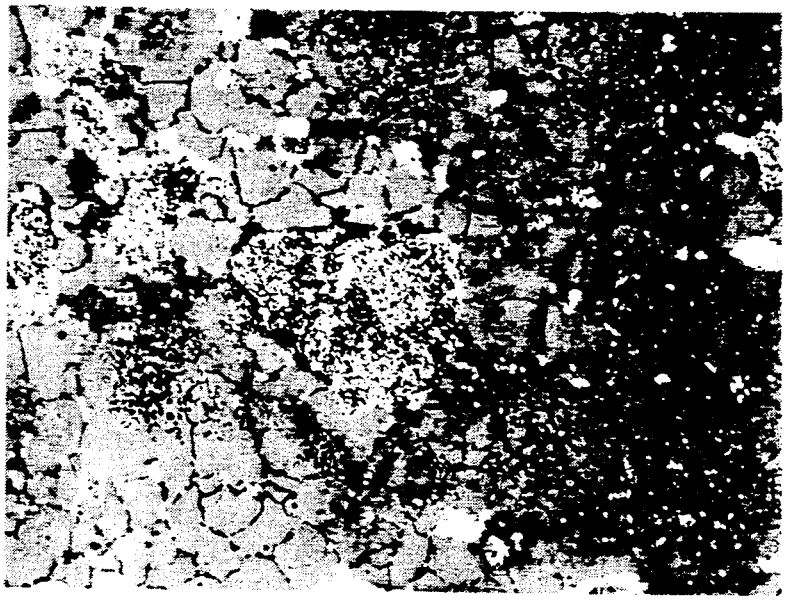
FIG. 3A is a metallographic photograph showing the Sample according to Example 3 before the wear test therefor.
Figure 3B:
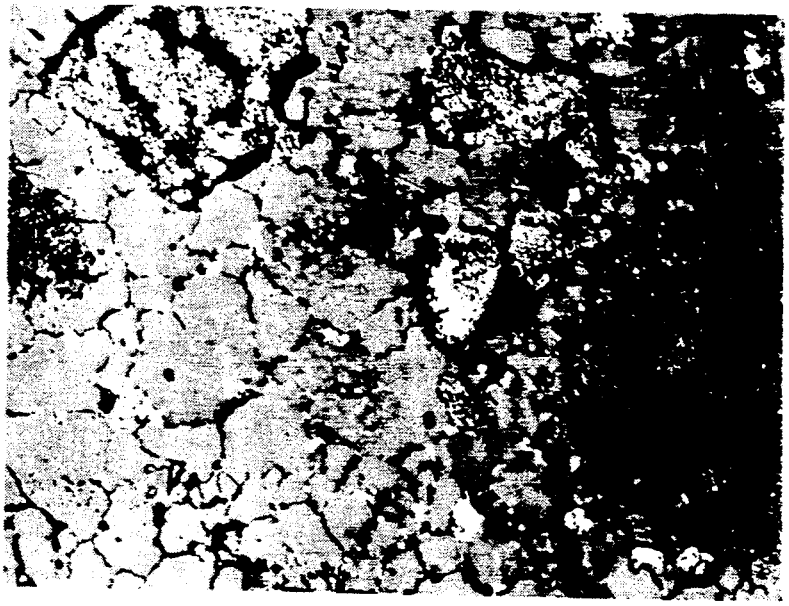
FIG. 3B is a metallographic photograph showing the same Sample after the wear test therefor.

The photographs showing the textures of the sample (valve seat) before and after the abrasion test are shown in FIGS. 3A and 3B.

EXAMPLE 4

A mixing operation and compression molding were effected in the same manner as in Example 1.

Then, the resultant product was subjected to a presintering operation by use of a vacuum furnace at a temperature of 700° C. for 60 min., and the thus obtained product was again pressed by use of an oil pressure press. Thereafter, the resultant compression molded product was subjected to a main sintering treatment by use of an AX furnace using a gas atmosphere/at a temperature of 1160° C. for 45 min. whereby a valve seat for an internal combustion engine was prepared.

The composition and the results of the respective tests are shown in Table 1 below.

EXAMPLES 5 TO 21 AND COMPARATIVE EXAMPLES 1 TO 8

Valve seats for an internal combustion engine were produced by use of mixed powders as shown in Table 1 appearing hereinafter, in the same manner as in Example 4.

Then, the thus obtained valve seats for an internal combustion engine were evaluated in the same manner as in Example 1.

The compositions and the results of the above tests are shown in Table 1 below.

The photographs showing the textures of the sample obtained in Comparative Example 1 as described above before and after the abrasion test are shown in FIGS. 3A and 3B.

Examination of the Results

As shown in the above Table 1, with respect to the valve seats for an internal combustion engine according to Examples, the abrasion loss of the valve seat per se and the valve to be used in combination therewith was about ½ that of the Comparative Examples. Accordingly, with respect to Examples, it was confirmed that the wear resistance was considerably improved and the hardness was also improved after the abrasion test, (i.e., the valve seats had a secondary hardening property). In addition, with respect to Examples it was confirmed that all of the density, radial crushing strength constant and cuttability were good and the corrosion resistance was also good.

In addition, as shown in FIGS. 1 to 3, the valve seats according to Comparative Examples showed no change in the austenite texture before and after the abrasion test. On the other hand, with respect to the valve seats according to Examples, it was confirmed that the amount of minute carbide contained in the austenite particles was increased and the austenite texture was transformed into the martensite texture after the abrasion test.

In addition, with respect to the valve seat material samples obtained in Example 1 and Comparative Example 1, the peaks shown in the X ray spectrum were examined.

Figures 4A, 4B, 4C, 4D:
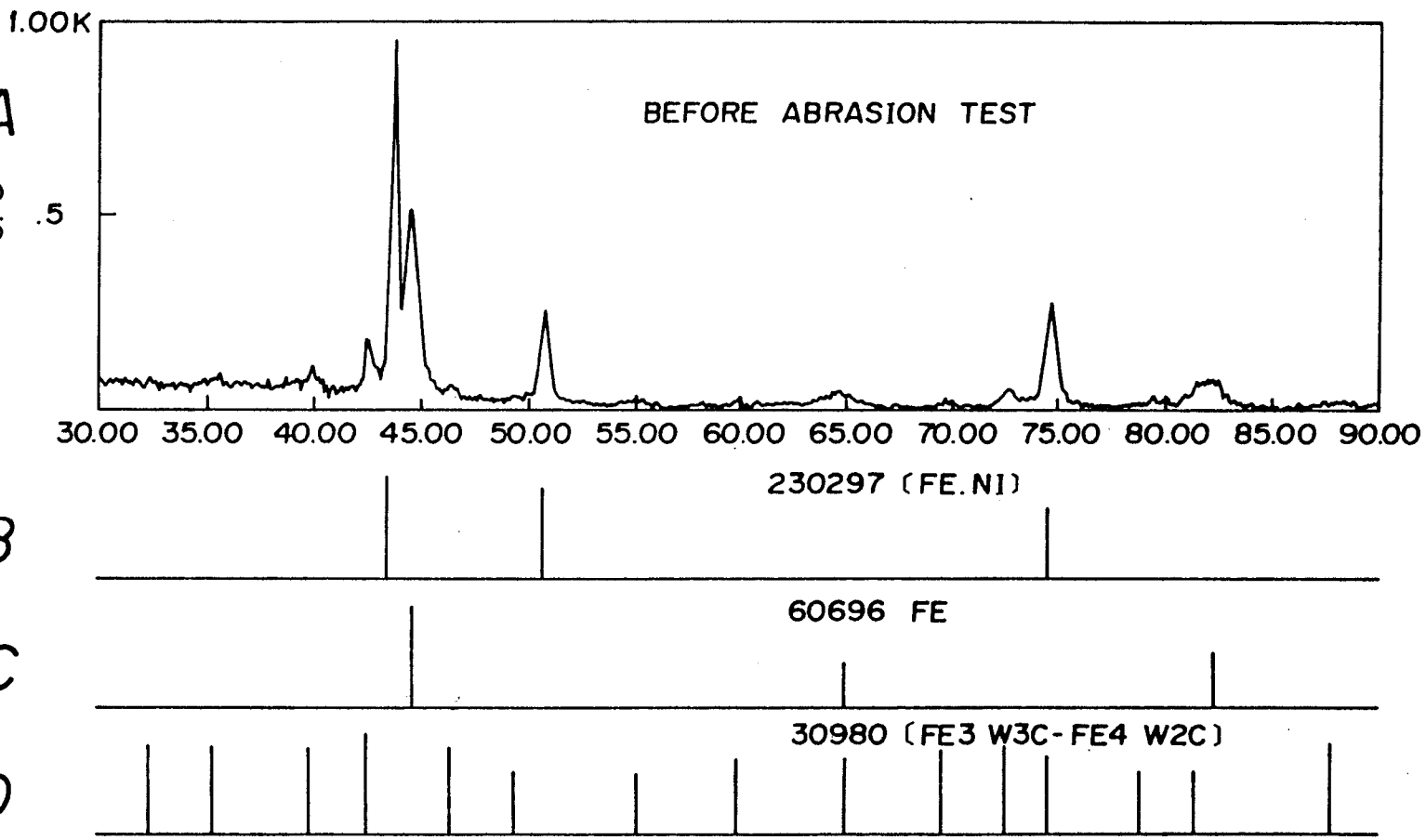
FIG. 4A is an X ray spectrum of the Sample according to Example 1 before the wear test therefor.
FIG. 4B is a view for illustrating the peaks shown in the X ray spectrum of the austenite.
FIG. 4C is a view for illustrating the peaks shown in the X ray spectrum of the martensite.
FIG. 4D is a view for illustrating the peaks shown in the X ray spectrum of the $M_6C$ type metal carbide.
Figures 5A, 5B, 5C, 5D:
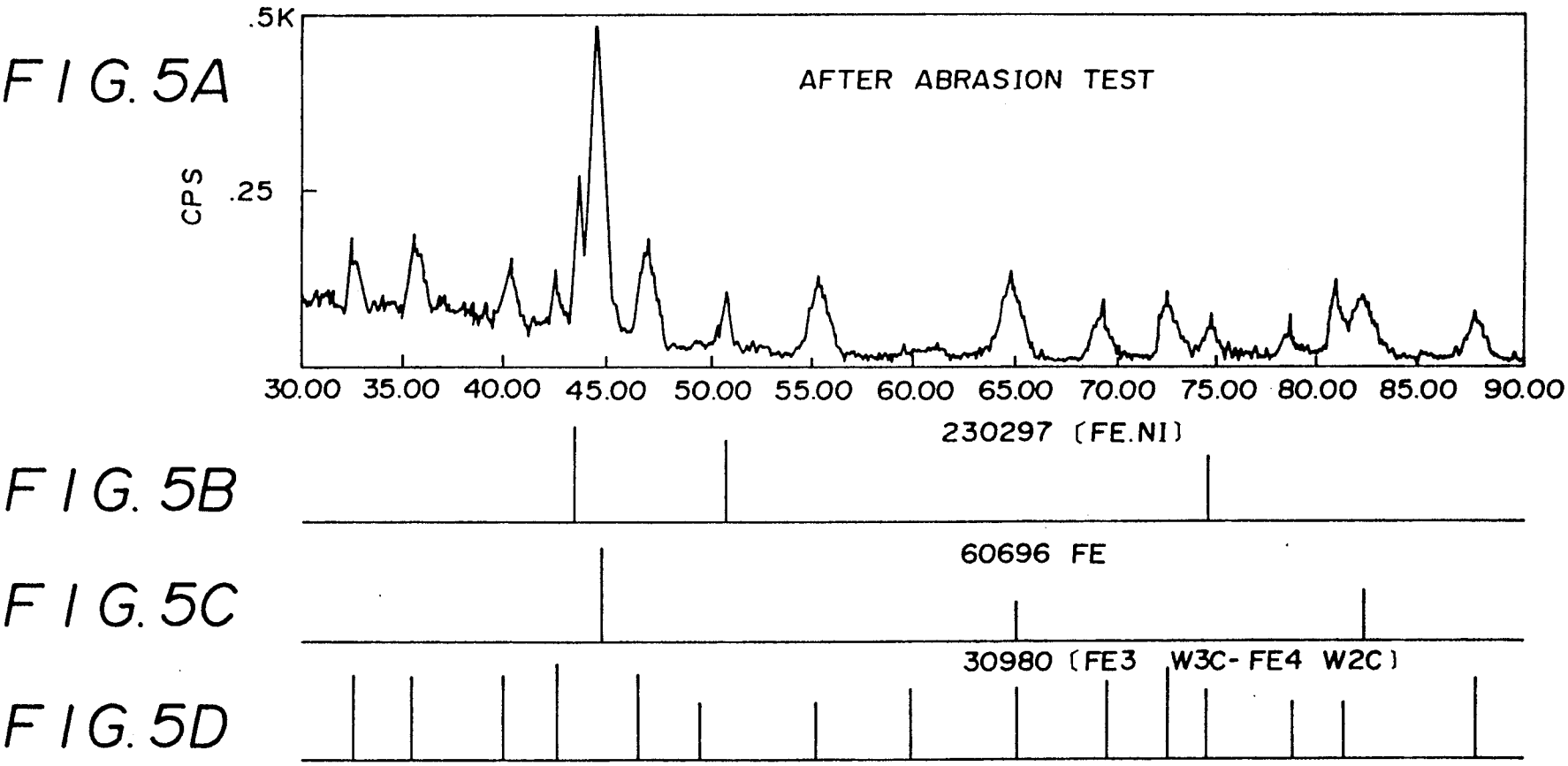
FIG. 5A is an X ray spectrum of the Sample according to Example 1 after wear test therefor.
FIG. 5B is a view for illustrating the peaks shown in the X ray spectrum of the austenite.
FIG. 5C is a view for illustrating the peaks shown in the X ray spectrum of the martensite.
FIG. 5D is a view for illustrating the peaks shown in the X ray spectrum of the $M_6C$ type metal carbide.

FIG. 4A is an X ray spectrum of the Sample according to Example 1 before the wear test therefor, FIG. 4B is a view for illustrating the peaks shown in the X ray spectrum of the austenite, FIG. 4C is a view for illustrating the peaks shown in the X ray spectrum of the martensite, and FIG. 4D is a view for illustrating the peaks shown in the X ray spectrum of the $M_6C$ type metal carbide. FIG. 5A is an X ray spectrum of the Sample according to Example 1 after the wear test therefor, FIG. 5B is a view for illustrating the peaks shown in the X ray spectrum of the austenite, FIG. 5C is a view for illustrating the peaks shown in the X ray spectrum of the martensite, and FIG. 5D is a view for illustrating the peaks shown in the X ray spectrum of the $M_6C$ type metal carbide.

Figures 6A, 6B, 6C, 6D:
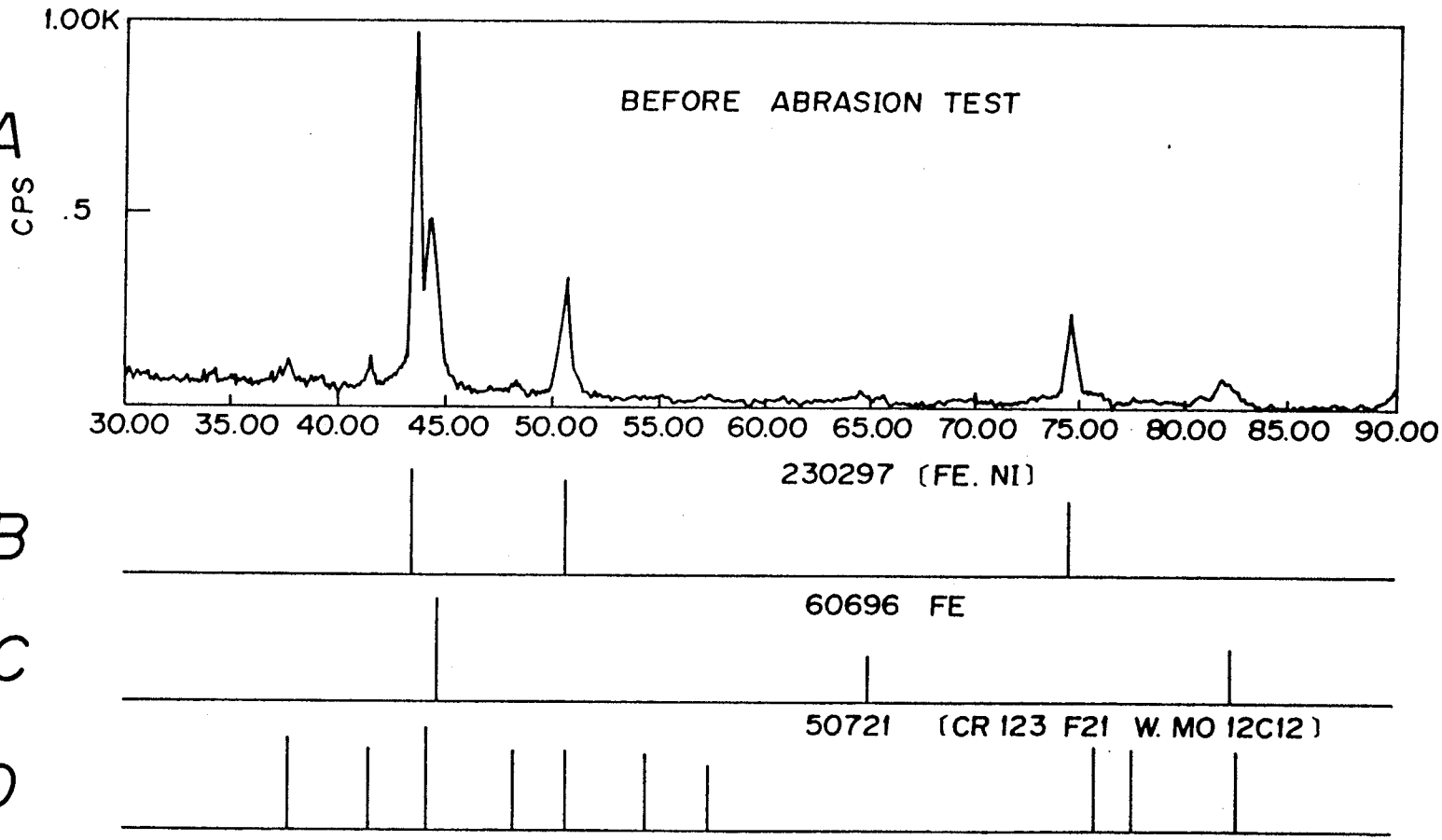
FIG. 6A is an X ray spectrum of the Sample according to Comparative Example 1 before the wear test therefor.
FIG. 6B is a view for illustrating the peaks shown in the X ray spectrum of the austenite.
FIG. 6C is a view for illustrating the peaks shown in the X ray spectrum of the martensite.
FIG. 6D is a view for illustrating the peaks shown in the X ray spectrum of the $M_6C$ type metal carbide.

FIG. 6A is an X ray spectrum of the Sample according to Comparative Example 1 before the wear test therefor, FIG. 6B is a view for illustrating the peaks shown in the X ray spectrum of the austenite, FIG. 6C is a view for illustrating the peaks shown in the X ray spectrum of the martensite, and FIG. 6D is a view for illustrating the peaks shown in the X ray spectrum of the $M_6C$ type metal carbide.

Figures 7A, 7B, 7C, 7D:
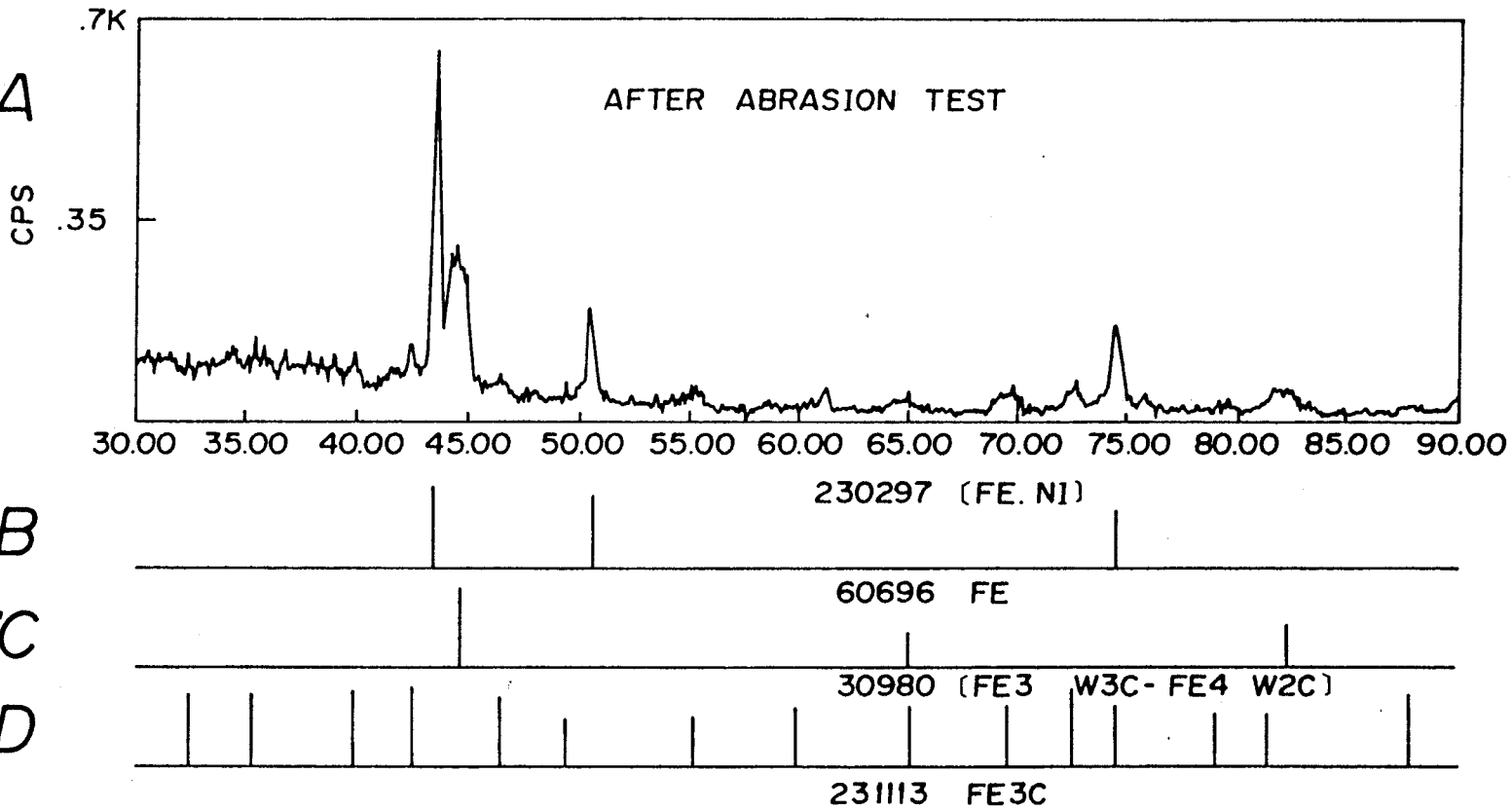
FIG. 7A is an X ray spectrum of the Sample according to Comparative Example 1 after the wear test therefor.
FIG. 7B is a view for illustrating the peaks shown in the X ray spectrum of the austenite.
FIG. 7C is a view for illustrating the peaks shown in the X ray spectrum of the martensite.
FIG. 7D is a view for illustrating the peaks shown in the X ray spectrum of the $M_6C$ type metal carbide.

FIG. 7A is an X ray spectrum of the Sample according to Comparative Example 1 before the wear test therefor, FIG. 7B is a view for illustrating the peaks shown in the X ray spectrum of the austenite, FIG. 7C is a view for illustrating the peaks shown in the X ray spectrum of the martensite, and FIG. 7D is a view for illustrating the peaks shown in the X ray spectrum of the $M_6C$ type metal carbide.

Also in view of the above X ray spectra, it was confirmed that the valve seat according to Comparative Example showed no change in the austenite texture before and after the abrasion test, but it was confirmed that in the valve seat according to Example, the texture which had been the austenite texture before the abrasion test was transformed into the martensite texture after the abrasion test.

As described hereinabove, according to the present invention, there is provided a secondary hardening type high temperature wear-resistant sintered alloy which has improved characteristics such as wear resistance, heat resistance and strength, and also has a good workability and a sufficient corrosion resistance. and therefore may suitably be used as a material for forming a valve seat for an internal combustion engine. More specifically, when a valve seat for an internal combustion engine, particularly a valve seat on the exhaust side thereof, is formed by use of the secondary hardening type high temperature wear-resistant sintered alloy according to the present invention, it shows a good powder compression property during production, but also shows a good workability because of the low hardness sintering. In addition, such a valve is further hardened in the initial stage of the use thereof on the basis of the combustion heat and the striking by the valve so that it may be provided with the wear resistance, heat resistance and strength which are required for the valve seat. In addition, the secondary hardening type high temperature wear-resistant sintered alloy according to the present invention shows an excellent corrosion resistance to formic acid. Accordingly, the present alloy is suitable for a valve seat for an engine using an alcohol fuel. Furthermore, when such an alloy is used for a valve seat on the induction side in place of that on the exhaust side, it is secondarily hardened so as to provide the hardness which is required for such a valve. Accordingly, since the secondary hardening type high temperature wear-resistant sintered alloy according to the present invention is usable for both of the valves on the intake and exhaust sides, it may provide an excellent production efficiency and such a production process may easily be controlled.

TABLE 1 (1)

Compositions of sample materials obtained in Examples 1 to 11

| | Chemical components of base material (wt. %) | | | | | | | | | | | | | | | |
|---|---|---|---|---|---|---|---|---|---|---|---|---|---|---|---|---|
| | C | W | Mo | V | Ti | Nb | Ta | B | Ni | Co | Cu | Cr | Al | Si, Mn | P | S |
| Example 1 | 0.6 | — | 6 | — | 0.6 | — | — | — | 18 | 4 | — | — | 0.1 | 0.85, 0.15 | 0.086 | 0.009 |
| Example 2 | 0.4 | — | 4 | — | — | 0.3 | — | — | 8 | 4 | — | — | — | — | — | — |
| Example 3 | 0.6 | — | 10 | — | — | 0.6 | — | — | 18 | 4 | — | — | — | — | — | |
| Example 4 | 0.6 | — | 6 | — | 0.6 | — | — | — | 18 | 10 | — | — | 0.1 | — | — | — |
| Example 5 | 0.8 | — | 4 | — | — | 0.3 | — | — | 8 | 4 | — | — | — | — | 0.3 | — |
| Example 6 | 0.6 | — | 6 | — | 0.6 | — | — | — | 12 | 8 | 3 | 7.2 | 0.1 | — | 0.004 | — |
| Example 7 | 0.2 | — | 10 | — | — | 0.6 | — | — | 18 | 4 | — | — | — | — | — | — |
| Example 8 | 0.6 | — | 6 | — | 0.6 | — | — | — | 18 | 10 | — | — | 0.1 | — | — | — |
| Example 9 | 0.4 | — | 2 | — | — | — | — | — | 12 | 8 | — | — | — | — | 0.2 | — |
| Example 10 | 0.4 | — | 10 | — | — | — | — | — | 8 | 8 | — | — | — | — | 0.2 | — |
| Example 11 | 0.4 | 2 | 10 | — | — | — | — | — | 8 | 8 | — | — | — | — | — | — |

TABLE 1 (2)

Compositions of sample materials obtained in Examples 12 to 21 and Comparative Examples 1 to 8

| | Chemical components of base material (wt. %) | | | | | | | | | | | | | | | |
|---|---|---|---|---|---|---|---|---|---|---|---|---|---|---|---|---|
| | C | W | Mo | V | Ti | Nb | Ta | B | Ni | Co | Cu | Cr | Al | Si, Mn | P | S |
| Example 12 | 0.4 | — | 6 | 2 | — | — | — | — | 10 | 4 | — | — | — | — | 0.3 | — |
| Example 13 | 0.4 | — | 6 | — | — | — | 2 | — | 10 | 4 | — | — | — | — | 0.3 | — |
| Example 14 | 0.4 | — | 6 | — | — | — | — | 2 | 10 | 4 | — | — | — | — | 0.3 | — |
| Example 15 | 0.4 | — | 2 | — | — | — | — | — | 10 | 4 | — | 4 | — | — | 0.2 | — |
| Example 16 | 0.4 | — | 2 | — | — | — | — | — | 6 | 4 | — | — | — | — | 0.2 | — |
| Example 17 | 0.4 | — | 2 | — | — | — | — | — | 6 | 4 | — | — | — | — | 0.2 | — |
| Example 18 | 0.4 | — | 2 | — | — | — | — | — | 6 | 4 | — | — | — | — | 0.2 | — |
| Example 19 | 0.8 | — | 4 | — | — | 0.3 | — | — | 8 | 4 | — | — | — | — | 0.3 | — |
| Example 20 | 0.8 | — | 4 | — | — | 0.3 | — | — | 8 | 4 | — | — | — | — | 0.3 | — |
| Example 21 | 0.8 | — | 4 | — | — | 0.3 | — | — | 8 | 4 | — | — | — | — | 0.3 | — |
| Comparative Example 1 | 0.15 | — | 6 | — | 0.6 | — | — | — | 18 | 4 | — | — | 0.1 | — | — | — |
| Comparative Example 2 | 1.00 | — | 6 | — | 0.6 | — | — | — | 18 | 4 | — | — | 0.1 | — | — | — |
| Comparative Example 3 | 0.8 | — | 10 | — | 0.32 | — | — | — | 18 | 4 | — | — | 0.1 | — | — | — |
| Comparative Example 4 | 0.8 | — | 10 | 3 | — | 3.5 | — | — | 18 | 4 | — | — | 0.1 | — | — | — |
| Comparative Example 5 | 0.8 | — | 10 | — | 1.5 | 5.2 | — | — | 18 | 10 | — | — | 0.1 | — | — | — |
| Comparative Example 6 | 0.9 | — | 10 | — | 0.6 | — | — | — | 18 | 10 | 4 | 7 | 0.1 | — | — | — |
| Comparative Example 7 | 0.9 | — | 10 | — | 0.6 | — | — | — | 5.0 | — | — | — | 0.1 | — | — | — |
| Comparative Example 8 | 1.1 | — | — | — | — | — | — | — | — | 6 | — | — | — | — | — | — |

TABLE 1 (3)

| | Mixed powder for sample material used in Examples 1 to 10 | | | | |
|---|---|---|---|---|---|
| | Mixed powder | | | | |
| | Base powder | Graphite powder (wt. %) | Alloy element Powder (wt. %) | Hard particle (wt. %) | Self-lubricating material (wt. %) |
| Example 1 | 18Ni—6Mo—4Co—0.6Ti—0.1Al—Fe atomized powder | 0.6% | Co 6% | Powder A*1 11.5% | — |
| Example 2 | 8Ni—4Mo—4Co—0.3Nb—Fe atomized powder | 0.6% | Co 3%<br>Ni 4% | Powder A*1 10%<br>powder B*2 16.5% | — |
| Example 3 | 18Ni—10Mo—4Co—0.6Nb—Fe atomized powder | 0.6% | Co 6% | Powder A*1 11.5% | — |
| Example 4 | 18Ni—6Mo—4Co—0.6Ti—0.1Al—Fe atomized powder | 0.6% | — | — | — |
| Example 5 | 8Ni—4Mo—4Co—0.3Nb—Fe atomized powder | 0.6% | Co 3%<br>Ni 4% | Powder A*1 16.5%<br>Powder B*2 10% | — |
| Example 6 | 12Ni—6Mo—4Co—0.6Ti—0.1Al—Fe atomized powder | 0.6% | Co 4%<br>Cu 3% | Powder A*1 11.5% | — |
| Example 7 | 18Ni—10Mo—4Co—0.6Nb—Fe atomized powder | 0.6% | Co 6% | Powder A*1 11.5% | — |
| Example 8 | 18Ni—10Mo—4Co—0.6Ti—0.1Al—Fe atomized powder | 0.6% | Co 6% | | — |
| Example 9 | 6Ni—2Mo—4Co—Fe atomized powder | 0.6% | Co 4%<br>Ni 6% | Powder B*2 20% | — |
| Example 10 | 6Ni—10Mo—4Co—Fe atomized powder | 0.6% | Co 4%<br>Ni 2% | Powder B*2 1.5% | |

*1Powder A: 19W—10Co—3C—5Fe—Cr,
*2Powder B: 60Mo—Fe

TABLE 1 (4)

| | Mixed powder for sample material used in Examples 11 to 21 | | | | |
|---|---|---|---|---|---|
| | Mixed powder | | | | |
| | Base powder | Graphite powder (wt. %) | Alloy element powder (wt. %) | Hard particle (wt. %) | Self-lubricating material (wt. %) |
| Example 11 | 6Ni—10Mo—4Co | 0.6% | Co 4%<br>Ni 2% | Powder B*2 11.5% | — |
| Example 12 | 6Ni—6Mo—4Co—2V—0.3P—Fe | 0.6% | Ni 4% | Powder B*2 15% | — |
| Example 13 | 6Ni—6Mo—4Co—2Ta—0.3P—Fe | 0.6% | Ni 4% | Powder B*2 15% | — |
| Example 14 | 6Ni—6Mo—4Co—2B—0.3P—Fe | 0.6% | Ni 4% | Powder B*2 15% | — |
| Example 15 | 6Ni—2Mo—4Co—4Cr—0.3P—Fe | 0.6% | Ni 4% | Powder B*2 20% | — |
| Example 16 | 6Ni—2Mo—4Co—Fe | 0.6% | Ni 6%<br>Co 2% | Powder B*2 15%<br>Powder C*3 10% | — |
| Example 17 | 6Ni—2Mo—4Co—Fe | 0.6% | Ni 6%<br>Co 2% | $Cr_2C_2$ 10%<br>WC 5% | — |
| Example 18 | 6Ni—2Mo—4Co—Fe | 0.6% | Ni 6%<br>Co 2% | $Al_2O_3$ 15% | — |
| Example 19 | 8Ni—4Mo—4Co—0.3Nb—Fe atomized powder | 0.6% | Co 3%<br>Ni 4% | Powder A*1 16.5%<br>Powder B*2 10% | $CaF_2$ 1.0% |
| Example 20 | 8Ni—4Mo—4Co—0.3Nb—Fe atomized | 0.6% | Co 3%<br>Ni 4% | Powder A*1 16.5%<br>Powder B*2 10% | $MnS_2$ 0.5% |
| Example 21 | 8Ni—4Mo—4Co—0.3Nb—Fe atomized | 0.6% | Co 3%<br>Ni 4% | Powder A*1 16.5%<br>Powder B*2 10% | Pb 15% |

*1Powder A: 19W—10Co—3C—5Fe—Cr
*2Powder B: 60Mo—Fe
*3Powder C: 15Cr—2Mo—3.5C—Fe

TABLE 1 (5)

| | Mixed powder for sample material used in Comparative Examples 1 to 8 | | | | |
|---|---|---|---|---|---|
| | Mixed powder | | | | |
| material | Base powder | Graphite powder (wt. %) | Alloy element powder (wt. %) | Hard particle (wt. %) | Self-lubricating material |
| Comparative Example 1 | The same as in Example 1 | 0.6% | The same as in Example 1 | The same as in Example 1 | — |
| Comparative Example 2 | The same as in Example 1 | 0.6% | The same as in Example 1 | The same as in Example 1 | — |
| Comparative Example 3 | The same as in Example 1 | 0.6% | The same as in Example 1 | The same as in Example 1 | — |
| Comparative Example 4 | 18Ni—10Mo—4Co—3V—3.5Nb—Fe | 0.6 | Co 6% | Powder A*1 10% | — |
| Comparative Example 5 | 18Ni—10Mo—4Co—1.5Ti—5.2Nb—0.1Al—Fe | 0.6% | Co 6% | Powder A*1 10% | — |
| Comparative Example 6 | 18Ni—10Mo—4Co—7Cr—0.6Ti—0.1Al—Fe | 0.6%<br>0.6% | Co 6%<br>Cu 4% | Powder A*1 15% | — |
| Comparative Example 7 | 5Ni—10Mo—0.6Ti—0.1Al—Fe | 0.6% | — | Powder A*1 15% | — |

TABLE 1 (5)-continued

| | Mixed powder for sample material used in Comparative Examples 1 to 8 | | | | |
|---|---|---|---|---|---|
| | Mixed powder | | | | |
| material | Base powder | Graphite powder (wt. %) | Alloy element powder (wt. %) | Hard particle (wt. %) | Self-lubricating material |
| Comparative Example 8 | 6Ni—2Mo—4Co—Fe | 0.6%<br>0.6% | Ni 6%,<br>Co 2% | Powder B*2 15%<br>Powder C*3 10% | — |

*1Powder A: 19W—10Co—3C—5Fe—Cr
*2Powder B: 60Mo—Fe
*3Powder C: 15Cr—2Mo—3.5C—Fe

TABLE 1 (6)

| | Results of measurement in Examples 1 to 16 | | | | | | |
|---|---|---|---|---|---|---|---|
| | Abrasion loss(μ) | | Hardness Base material texture (Hv) | | Sintered | | Radial crushing |
| Example | Valve seat | Valve | Before abrasion test | After abrasion test | Product($H_{RB}$) Before abrasion | Density (g/cm$^3$) | strength (Kgf/mm$^2$) |
| Example 1 | 4.0 | 9.0 | 277 | 608 | 79 | 6.72 | 49.5 |
| Example 2 | 3.5 | 13.5 | 507 | 648 | 81 | 6.75 | 51.0 |
| Example 3 | 7.9 | 12.0 | 280 | 431 | 84 | 7.7 | 79.2 |
| Example 4 | 4.0 | 7.5 | 280 | 590 | 89 | 6.95 | 58.0 |
| Example 5 | 4.5 | 10.0 | 480 | 655 | 92 | 7.02 | 65.0 |
| Example 6 | 3.0 | 10.5 | 320 | 605 | 83 | 6.75 | 52.0 |
| Example 7 | 8.2 | 10.5 | 520 | 630 | 83 | 6.73 | 52.5 |
| Example 8 | 8.5 | 6.5 | 280 | 595 | 75 | 6.78 | 55.0 |
| Example 9 | 6.5 | 3.5 | 320 | 485 | 90 | 6.89 | 62.0 |
| Example 10 | 5.0 | 4.5 | 390 | 580 | 93 | 6.80 | 58.5 |
| Example 11 | 4.0 | 6.0 | 320 | 450 | 89 | 6.75 | 48.5 |
| Example 12 | 12.0 | 13.5 | 501 | 620 | 91 | 6.75 | 59.5 |
| Example 13 | 10.5 | 12.5 | 420 | 500 | 88 | 6.80 | 61.0 |
| Example 14 | 8.0 | 9.5 | 350 | 540 | 94 | 6.90 | 62.5 |
| Example 15 | 10.0 | 8.5 | 320 | 560 | 92 | 6.85 | 60.5 |
| Example 16 | 6.0 | 5.0 | 510 | 780 | 97 | 6.91 | 66.5 |

TABLE 1 (7)

| | Results of measurement in Examples 17 to 21 and comparative Examples 1 to 8 | | | | | | |
|---|---|---|---|---|---|---|---|
| | Abrasion loss(μ) | | Hardness Base material texture (Hv) | | Sintered | | Radial crushing |
| Example | Valve seat | Valve | Before abrasion test | After abrasion test | Product($H_{RB}$) Before abrasion | Density (g/cm$^3$) | strength (Kgf/mm$^2$) |
| Example 17 | 3.0 | 8.5 | 495 | 810 | 95 | 7.08 | 66.5 |
| Example 18 | 3.5 | 11.0 | 490 | 790 | 96.5 | 7.10 | 64.5 |
| Example 19 | 4.0 | 8.0 | 435 | 630 | 92 | 7.01 | 63.5 |
| Example 20 | 3.5 | 6.5 | 450 | 680 | 90.5 | 7.02 | 64.0 |
| Example 21 | 4.0 | 8.5 | 470 | 650 | 91 | 7.02 | 63.0 |
| Comparative Example 1 | 39.5 | 21.5 | 250 | 265 | 75 | 6.74 | 41.0 |
| Comparative Example 2 | 17.0 | 15.0 | 421 | 398 | 92 | 6.65 | 45.5 |
| Comparative Example 3 | 27.0 | 13.0 | 268 | 275 | 75 | 6.52 | 40.1 |
| Comparative Example 4 | 24.5 | 26.0 | 511 | 509 | 108 | 6.85 | 65.5 |
| Comparative Example 5 | 23.8 | 31.0 | 485 | 478 | 112.5 | 7.08 | 78.6 |
| Comparative Example 6 | 26.0 | 14.5 | 271 | 268 | 80 | 6.78 | 58.0 |
| Comparative Example 7 | 19.5 | 18.5 | 315 | 315 | 95 | 6.90 | 60.5 |
| Comparative Example 8 | 16.0 | 18.0 | 260 | 260 | 94 | 6.87 | 49.8 |

TABLE 1 (8)

| | Results of measurement in Examples 1 to 11 | | | |
|---|---|---|---|---|
| | Bit abrasion loss Cuttability cutting test condition V = 50 m/mm f = 0.15 mm/rev | Micro texture change | | Corrosion resistance (to formic acid) Loss in weight due |
| Example | d = 0.5 mm | Before abrasion test | After abrasion test | to corrosion |
| Example 1 | 0.32 | $\gamma_R$ + minute carbide | martensite + minute | 0.05% |

TABLE 1 (8)-continued

| Example | Bit abrasion loss Cuttability cutting test condition V = 50 m/mm f = 0.15 mm/rev d = 0.5 mm | Results of measurement in Examples 1 to 11 — Micro texture change: Before abrasion test | After abrasion test | Corrosion resistance (to formic acid) Loss in weight due to corrosion |
|---|---|---|---|---|
| | | in particle | carbide in particle | |
| Example 2 | 0.45 | Pearlite | Pearlite Martensite + carbide in | 0% |
| | | $\gamma_R$ + minute carbide in particle | in particle | |
| Example 3 | 0.51 | $\gamma_R$ + MoC minute carbite in particle | Martensite + MoC munite carbite in particle | 0.03% |
| Example 4 | 0.25 | The same as in Example 1 | | 0.02% |
| Example 5 | 0.50 | The same as in Example 2 | | 0.02% |
| Example 6 | 0.40 | Martensite $\gamma_R$ + minute carbide in particle | Martensite + minute carbide in particle | 0.06% |
| Example 7 | 0.45 | The same as in Example 3 | | 0.04% |
| Example 8 | 0.25 | The same as in Example 1 | | 0.05% |
| Example 9 | 0.45 | $\gamma_R$ + minute MoC in particle | Martensite + minute carbide in particle | 0.02% |
| Example 10 | 0.40 | $\gamma_R$ + minute MoC in particle | Martensite + minute carbide in particle | 0.03% |
| Example 11 | 0.50 | $\gamma_R$ = minute MoC in particle | Martensite + minute carbide in particle | 0.03% |

TABLE 1 (9)

| Example | Bit abrasion loss Cuttability cutting test condition V = 50 m/mm f = 0.15 mm/rev d = 0.5 mm | Results of measurement in Examples 12 to 21 — Micro texture change: Before abrasion test | After abrasion test |
|---|---|---|---|
| Example 12 | 0.50 | Pearlite $\gamma_R$ + minute carbide in particle | Martensite (partially $\gamma$) + minute carbide in particle |
| Example 13 | 0.48 | Pearlite $\gamma_R$ + minute carbide in particle | Martensite (partially $\gamma$) + minute carbide in particle |
| Example 14 | 0.51 | Pearlite $\gamma_R$ + minute carbide in particle | Martensite (partially $\gamma$) + minute carbide in particle |
| Example 15 | 0.55 | Pearlite $\gamma_R$ + carbide in particle | — |
| Example 16 | 0.54 | Pearlite $\gamma_R$ + minute carbide in particle | Martensite + minute carbide |
| Example 17 | 0.65 | Pearlite $\gamma_R$ + minute carbide in particle | Martensite + minute carbide |
| Example 18 | 0.60 | Pearlite $\gamma_R$ + minute carbide in particle | Martensite + minute carbide |
| Example 19 | 0.40 | Pearlite $\gamma_R$ + minute carbide in particle + $CaF_2$ | Pearlite + Martensite + minute carbide in particle + $CaF_2$ |
| Example 20 | 0.35 | Pearlite $\gamma_R$ + minute carbide in particle + $MnS_2$ | Pearlite + Martensite + minute carbide in particle + $MnS_2$ |
| Example 21 | 0.40 | Pearlite $\gamma_R$ + minute carbide in particle + Pb | Pearlite + Martensite + minute carbide in particle + Pb |

TABLE 1 (10)

| Example | Bit abrasion loss Cuttability cutting test condition V = 50 m/mm f = 0.15 mm/rev d = 0.5 mm | Comparative Examples 1 to 8 — Micro texture change: Before abrasion test | After abrasion test |
|---|---|---|---|
| Comparative | 0.35 | Ferrite $\gamma_R$ + minute | The same as the left column |

TABLE 1 (10)-continued

| Example | Bit abrasion loss Cuttability cutting test condition V = 50 m/mm f = 0.15 mm/rev d = 0.5 mm | Comparative Examples 1 to 8 Micro texture change Before abrasion test | After abrasion test |
|---|---|---|---|
| Example 1 | | carbide in particle | |
| Comparative Example 2 | 0.55 | Pearlite, martensite | The same as the left column |
| Comparative Example 3 | 0.30 | Pearlite $\gamma_R$ + minute carbide in particle (too little) | Pearlite $\gamma_R$ + martensite |
| Comparative Example 4 | 0.65 | Pearlite $\gamma_R$ + large carbide in particle (much) | The same as the left column |
| Comparative Example 5 | 0.60 | Pearlite $\gamma_R$ + large carbide in particle (much) | The same as the left column |
| Comparative Example 6 | 0.70 | Pearlite $\gamma_R$ + carbide in particle | The same as the left column |
| Comparative Example 7 | 0.55 | Pearlite $\gamma^R$ (partially) | The same as the left column |
| Comparative Example 8 | 0.52 | Pearlite · highalloy phase | The same as the left column |

What is claimed is:

1. A secondary hardening type high temperature wear-resistant sintered alloy body, comprising:

0.4 to 15 wt. % of at least one species of metal carbide forming element which is selected from the group consisting of W, Mo, V, Ti, Nb, Ta and B;

5 to 35 wt. % of at least one species of austenite forming element which is selected from the group consisting of Ni, Co, Cu, and Cr;

0.2 to 1.2 wt. % of C; and 0.04 to 0.2 wt. % of Al, the remainder consisting essentially of Fe, wherein the alloy body contains an austenite phase which is capable of martensitic transformation.

2. The secondary hardening type high temperature wear resistant sintered alloy body of claim 1, further comprising not more than 30 wt. % of hard particles.

3. The secondary hardening type high temperature wear resistant sintered alloy body of claim 1, further comprising 0.1 to 0.6 wt. % of P.

4. The secondary hardening type high temperature wear resistant sintered alloy body of claim 1, further comprising 0.1 to 0.6 wt. % of P and not more than 30 wt. % of hard particles.

5. The secondary hardening type high temperature wear-resistant sintered alloy body of claim 1, further comprising a self-lubricating material deposited at grain boundaries or in grain of the alloy body, said self-lubricating material being present in an amount of 0.2 to 5 wt. %.

6. The secondary hardening type high temperature wear-resistant sintered alloy body of claim 5, wherein the self-lubricating material is selected from the group consisting of fluoride, sulfide, and lead oxide.

7. The secondary hardening type high temperature wear resistant sintered alloy body of claim 1, further comprising a sealing agent for sealing pores of the sintered alloy body, said sealing agent comprising at least one species which is selected from the group consisting of Cu, Pb, a Cu alloy, and a Pb alloy.

* * * * *